US009662850B2

(12) United States Patent
Pannewitz et al.

(10) Patent No.: US 9,662,850 B2
(45) Date of Patent: May 30, 2017

(54) PRESS FOR PRODUCING A PELLET FROM POWDERED MATERIAL

(71) Applicant: Fette Compacting GmbH, Schwarzenbek (DE)

(72) Inventors: Thomas Pannewitz, Klein Pampau (DE); Stephan Mallon, Kollow (DE)

(73) Assignee: FETTE COMPACTING GMBH, Schwarzenbek (DE)

( * ) Notice: Subject to any disclaimer, the term of this patent is extended or adjusted under 35 U.S.C. 154(b) by 305 days.

(21) Appl. No.: 14/336,817

(22) Filed: Jul. 21, 2014

(65) Prior Publication Data

US 2015/0024078 A1 Jan. 22, 2015

(30) Foreign Application Priority Data

Jul. 22, 2013 (DE) ..... 10 2013 012 085

(51) Int. Cl.

| | |
|---|---|
| ***B30B 15/28*** | (2006.01) |
| ***B30B 11/04*** | (2006.01) |
| ***B30B 1/18*** | (2006.01) |
| ***B30B 11/02*** | (2006.01) |
| ***B30B 15/00*** | (2006.01) |
| ***B30B 15/06*** | (2006.01) |

(52) U.S. Cl.

CPC ..... *B30B 15/28* (2013.01); *B30B 1/181* (2013.01); *B30B 11/02* (2013.01); *B30B 11/04* (2013.01); *B30B 15/007* (2013.01); *B30B 15/068* (2013.01)

(58) Field of Classification Search

CPC ..... B30B 15/28; B30B 11/02; B30B 15/068; B30B 11/04; B30B 15/007; B30B 1/181

See application file for complete search history.

(56) References Cited

U.S. PATENT DOCUMENTS

2014/0287078 A1* 9/2014 Behns ..... B30B 1/181 425/78

FOREIGN PATENT DOCUMENTS

| | | | |
|---|---|---|---|
| DE | 10 2011 116 548 | A1 | 4/2013 |
| DE | 102011116552 | A1 | 4/2013 |
| JP | 64-6554 | A | 1/1989 |
| WO | 2013/178355 | A1 | 12/2013 |

* cited by examiner

*Primary Examiner* — Robert J Grun

(74) *Attorney, Agent, or Firm* — Vidas Arrett & Steinkraus

(57) ABSTRACT

The invention relates to a press for producing a pellet from powdered material, comprising a press frame and a press unit arranged in the press frame with at least one upper press punch and/or at least one lower press punch, as well as at least one receptacle for the powdered material to be pressed by the upper and/or lower press punch, at least two upper drive units, each with one upper electric drive motor for moving the upper press punch in a vertical direction.

14 Claims, 3 Drawing Sheets

PRESS FOR PRODUCING A PELLET FROM POWDERED MATERIAL

CROSS-REFERENCE TO RELATED APPLICATIONS

Not Applicable

STATEMENT REGARDING FEDERALLY SPONSORED RESEARCH

Not Applicable

FIELD OF THE INVENTION

The invention relates to a press for producing a pellet from powdered material, comprising a press frame and a press unit arranged in the press frame with at least one upper press punch and/or at least one lower press punch, as well as at least one receptacle for the powdered material to be pressed by the upper and/or lower press punch, at least two upper drive units, each with one upper electric drive motor for moving the upper press punch in a vertical direction, wherein the upper drive units each comprise one upper spindle drive driven by the respective electric drive motor and having an upper spindle and an upper spindle nut, and/or at least two lower drive units, each with a lower electric drive motor for moving the lower press punch and/or the receptacle in a vertical direction, wherein the lower drive units each comprise a lower spindle drive driven by the respective electric drive motor and having a lower spindle and a lower spindle nut, wherein the upper drive units act laterally offset on the at least one upper press punch by means of an upper power transmission bridge extending in a horizontal direction, and/or wherein the lower drive units act laterally offset on the at least one lower press punch and/or the receptacle by means of a lower power transmission bridge extending in a horizontal direction.

BACKGROUND OF THE INVENTION

A press for producing a pellet from powdered material is for example known from EP 2 479 022 A1, the entire contents of which are hereby incorporated by reference. Flexible connecting means are provided for example between an intermediate element connected to two parallel drive means acting along the vertical axis and the drive means. Furthermore, flexible connecting means can be provided between the intermediate element and a die plate or another intermediate element. Misalignments of parts that can be moved and guided along the vertical axis of the press are avoided by the flexible connecting means. In particular, a largely synchronous traveling movement of the drives is achieved.

The unpublished, parallel German patent application 10 2012 010 767.6, the entire contents of which are hereby incorporated by reference, by the applicant furthermore proposes arranging spring elements that, during a pressing operation, deform between the power transmission bridges acted upon by the drive units in a laterally offset manner, and the drive units. The drive units can in particular comprise spindle drives with spindles and spindle nuts. The spring elements largely minimize the influences on the pressing result from bending press components. In particular, bending moments acting on the spindle nuts are reduced.

In the operation of presses of the above-described type, significant bending moments act on drive components, in particular any spindle drives that may be provided. This holds true in particular when the drives act on opposite sides of a power transmission bridge extending in a horizontal direction. Given the enormous press forces, the power transmission bridges can significantly bend and thereby generate the noted bending moment. This problem is not solved, or is at least not completely solved, by the spring elements provided in the prior art.

BRIEF SUMMARY OF THE INVENTION

Proceeding from the prior art, the object of the invention is therefore to provide a press of the initially-cited type in which the effects of bending moments on the drives are further minimized during pressing.

The invention achieves this object through the subject disclosed herein. Advantageous embodiments can be found in the description and the figures.

The invention achieves the object for a press of the initially-cited type in that the upper spindle nuts, or the upper fastening elements each connected to the upper spindle nuts, are each connected to the upper power transmission bridge by at least one upper compensation element, wherein the compensation elements are each rotatably mounted on the upper spindle nuts, or the upper fastening elements on the one hand, and on the upper power transmission bridge on the other hand, and/or that the lower spindle nuts, or lower fastening elements connected to the lower spindle nuts, are each connected to the lower power transmission bridge by means of at least one lower compensation element, wherein the compensation elements are each rotatably mounted on the lower spindle nuts, or the lower fastening elements on the one hand and the lower power transmission bridge on the other hand.

The press according to the invention possesses a press frame that stands on feet or directly on the supporting surface. A press unit is arranged in the press frame and has at least one upper press punch and/or at least one lower press punch. This press unit furthermore possesses a receptacle in which powder to be pressed is added before pressing by the press punch(es).

The powdered material can for example be a metal or ceramic powder. The receptacle is arranged between the upper punch and the lower punch. Generally, the press comprises at least one upper and at least one lower punch that interact in the receptacle for pressing the added powder. It is, however, also conceivable to press for example only from above with only one upper punch when the receptacle has a closed floor.

The upper and/or lower press punches can be arranged on an upper or respectively lower punch plate. To vertically move the upper and/or lower punch during the pressing process, upper and/or lower drive units are provided that have upper and/or lower electric drive motors. In particular, at least two upper drive units and at least two lower drive units are provided. The upper or respectively lower drive units can be arranged symmetrically on opposite sides of the press frame. As explained, the lower drive units drive a lower press punch or a receptacle in a vertical direction. Operating the press is feasible both in an ejection process in which the receptacle is stationary and the upper and lower punches are moved relative to the receptacle, as well as in a withdrawal process in which the lower punch is stationary, and the receptacle as well as the upper punch are movable. In principle, the number of press axes and hence the simultaneously created pellets can be increased within broad limits with the press according to the invention. The press unit can form a module that is removed as a whole from the press and can be exchanged with another press unit also forming a module. The receptacle can be formed in a die plate. It can be securely arranged on the press frame.

The upper drive units act laterally offset on the at least one upper press punch by means of an e.g. bar-shaped upper power transmission bridge. Correspondingly, the lower drive units act laterally offset on the at least one lower press punch and/or the receptacle by means of the e.g. bar-shaped lower power transmission bridge. Thus, the drive units act off-center on the press punch, or respectively the receptacle. The direction of movement (or respectively direction of force) of the drive units is generally spaced parallel from the direction of movement (or respectively direction of force) of the upper punch and the lower punch, or respectively the receptacle. The drive units therefore act on the press unit in a non-coaxial manner. The power transmission bridges can for example be connected in the middle to the upper press punch, or respectively an upper punch plate bearing the upper press punch, or respectively to the lower press punch, or respectively a lower punch plate bearing the lower press punch, or the receptacle. At least one additional power transmission element can be provided between each of the power transmission bridges and the press punches, or respectively the receptacle. Of course, more than two, for example four upper, and/or more than two, for example four lower drive units, can in principle be provided. In this case, two drive units each can act on one end of the respective power transmission bridge.

The two upper, or respectively two lower drive units, act synchronously on the upper, or respectively lower, power transmission bridge. The upper or respectively lower drive units furthermore each comprise an upper or respectively lower spindle drive driven by the upper or respectively lower drive motor and having an upper or respectively lower spindle and an upper or respectively lower spindle nut. The upper or respectively lower spindle nuts are each connected to the upper or respectively lower power transmission bridge such that the upper or respectively lower power transmission bridge is moved together with the respective spindle nuts in an axial direction when the spindles are moved in the spindle nuts.

The force exerted by the drive units is transferred to the press unit by means of the respective power transmission bridge. Due to the offset acting of the drive units, the power transmission bridges can bend due to the very high force that can arise during the pressing process which, in the prior art, can lead to bending moments being applied to the spindle nuts and hence to an impairment of the functioning of the spindle drive. To solve this problem, the invention provides that the upper or respectively lower spindle nuts, or upper or respectively lower fastening elements connected to the upper or respectively lower spindle nuts, are each connected to the upper or respectively lower power transmission bridge by at least one upper or respectively lower compensation element. The compensation elements are, on the one hand, rotatably mounted to the upper or respectively the lower spindle nuts, or the upper or respectively the lower fastening elements. On the other hand, the compensation elements are rotatably mounted to the upper or respectively lower power transmission bridge. The compensation elements establish in particular the exclusive connection between the spindle nuts, or respectively the fastening elements, and the respective power transmission bridge.

The compensation elements can possess an elongated shape, and its opposite ends can then be rotatably mounted to the respective power transmission bridge on the one hand and the respective spindle nut, or respectively the respective fastening element, on the other hand. The compensation elements accordingly form a double joint. The power transmission bridges in combination with at least two double joints in each case further reduce transmission of bending moments to the spindle drives, in particular to the spindle nuts, in comparison to the prior art. Each shortening of the power transmission bridge due to bending, and hence a shortening of the distance between the bearing points of the compensation elements on the power transmission bridges, is compensated by a rotation of the compensation elements about the bearing points. The bending moments arising from a bending of the power transmission bridges is hence not transferred to the spindle drives, in particular to the spindle nuts.

Following the release after the end of the pressing process, the components move back into their initial position. Remaining force and moments applied to the spindle nuts only result from oblique force vectors/transverse forces as well as the friction moment of the pivot bearings. The compensation elements according to the invention are substantially non-flexible. In contrast to the prior art, no flexible elements are required; rather, tipping moment is compensated by the tilting of the compensation elements enabled by the pivot bearings.

The spindle drives generate torque, in particular opposing torque, that can act by means of the compensation elements on the first transmission bridge. Such torque is fundamentally undesirable. Consequently, a torque support or respectively anti-rotation element can be provided that prevents a transmission of torque to the power transmission bridges, yet however permits a deflection of the power transmission bridges. For example, a stiffening plate that is connected, e.g. screwed, to each spindle nut and e.g. can be arranged in a horizontal plane, has proven to be suitable in practice. The stiffening plate can be connected, e.g. also screwed, to the power transmission bridge by means of one or more support elements.

As mentioned, the compensation elements can either be rotatably mounted to the spindle nuts or to fastening elements connected to the spindle nuts. Such fastening elements are optional. Like the spindle nuts, they can be designed disk- or ring-shaped and can be arranged between a respective spindle nut and the respective power transmission bridge. It is, however, also possible for the spindle nuts to be arranged between such a fastening element and the respective power transmission bridge.

According to one embodiment, each of the upper spindle nuts, or respectively each upper fastening element connected to the upper spindle nuts, can be connected in each case to the upper power transmission bridge by two upper compensation elements, and/or each of the lower spindle nuts or respectively each lower fastening element connected to the lower spindle nuts, is connected in each case by two lower compensation elements to the lower power transmission bridge. The compensation elements can each be arranged upon opposing sides of the power transmission bridge. The compensating effect is further optimized by providing four compensation elements per power transmission bridge.

The bearing points for rotatably mounting the compensation elements can always be arranged over each other in a vertical direction when the press is in a state of rest, that is, before a pressing operation. The compensation elements are rotatably mounted to sections of the respective power transmission bridges arranged vertically over each other, and the respective spindle nuts, or respectively fastening elements. If the power transmission bridges bend during pressing, the compensation elements tip so that the bearing points are then arranged along a line running at an angle to the vertical. A particularly even compensating effect arises.

In principle, any type of pivot bearing is conceivable for the compensation elements. For example, the compensation elements can be rotatably mounted by roller bearings or friction bearings. The pivot bearings can each comprise bearing pins that are attached to the respective power transmission bridge and the respective spindle nuts, or respectively to the respective fastening element. Bearings corresponding to the bearing pins can then be provided on the compensation elements. A kinematic reversal is, however, also possible in which the bearing ends are formed on the compensation elements, and the bearings are correspondingly formed on the power transmission bridges and the spindle nuts, or respectively fastening elements.

Furthermore, the at least two upper drive units can act on the opposite ends of the upper power transmission bridge. Correspondingly, the at least two lower drive units can act on the opposite ends of the lower power transmission bridge. This embodiment is particularly suitable for the pressing operation. On the other hand, a particularly high bending moments act on the power transmission bridge that, however, can be reliably compensated according to the invention by the compensation elements.

It can be provided according to another embodiment that the upper spindles, and/or the upper spindle nuts, and/or the upper fastening elements do not touch the upper power transmission bridge when the press is in a state of rest and during a pressing operation, and/or the lower spindles, and/or the lower spindle nuts, and/or the lower fastening elements do not touch the lower power transmission bridge when the press is in a state of rest and during a pressing operation. According to this embodiment, the respective power transmission bridge can bend at least up to a certain limit without the power transmission bridge coming into direct contact with the spindle and/or its neighboring spindle nut, or respectively with its neighboring fastening element if available. Such a contact would cause a transmission of the bending moments to the spindle nut and hence possibly cause the spindle drives to tip. With a suitable constructive embodiment of the press components, the addressed limit to the bending of the respective power transmission bridge can be selected so that there is no undesirable contacting of the components and hence tipping moment exerted on the spindle drives also during the force arising in the context of a pressing operation.

A space can be formed between a bottom side or a top side of the upper power transmission bridge and a top side, or respectively a bottom side of the upper spindle nuts, or respectively the upper fastening elements, and/or a space can be formed between a bottom side or a top side of the lower power transmission bridge and a top side, or respectively a bottom side of the lower spindle nuts, or respectively the lower fastening elements. The space is formed between the components directly neighboring the power transmission bridge. As explained above, this can be the respective spindle nut. It can, however, be a fastening element connected to the spindle nut.

According to another embodiment, each of the opposite ends of the upper power transmission bridge can possess a cylindrical through-hole, each of which accommodates an upper spindle, wherein an annular gap is formed in each case between the insides of the through-holes in the upper power transmission bridge and the outsides of the upper spindles, and/or each of the opposite ends of the lower power transmission bridge possesses a cylindrical through-hole, each of which accommodates a lower spindle, wherein an annular gap is formed in each case between the insides of the through-holes in the lower power transmission bridge and the outsides of the lower spindles.

According to an alternative embodiment in this regard, a cylindrical upper projection is connected to each of the upper spindle nuts, wherein each of the opposite ends of the upper power transmission bridge can possess a cylindrical through-hole, each of which accommodates an upper projection, wherein an annular gap is formed in each case between the insides of the through-holes in the upper power transmission bridge and the outsides of the upper projections, and/or a cylindrical lower projection is connected to each of the lower spindle nuts, wherein each of the opposite ends of the lower power transmission bridge possesses a cylindrical through-hole, each of which accommodates a lower projection, wherein an annular gap is formed in each case between the insides of the through-holes in the lower power transmission bridge and the outsides of the lower projections.

In the two last-cited embodiments, the ends of the power transmission bridges each form bearing sections with cylindrical through-holes. The diameters of the cylindrical through-holes in these embodiments are greater by a specific value than the diameters of the (cylindrical) spindles, or respectively the cylindrical projections of the spindle nuts. This forms the annular gap.

In the aforementioned embodiments, spaces run around the spindles, or respectively the projections of the spindle nuts, and between the spindle nuts or respectively the fastening elements and the power transmission bridges. These are particularly practical embodiments for reliably avoiding the aforementioned contacts during operation. The gaps or respectively spaces can be selected to be correspondingly large enough so that a maximum bending of the power transmission bridge arising during pressing does not yield undesirable contact and hence tipping moment exerted on the spindle drives. The spaces between the power transmission bridges and the spindle nuts, or respectively the fastening elements, can for example possess a width of 1 to 10 mm, preferably 2 to 5 mm. Correspondingly, the annular gap between the spindles, or respectively the cylindrical projections on the spindle nuts, and the cylindrical through-holes in the power transmission bridges can possess a width of 1 to 10 mm, preferably 2 to 5 mm.

According to another particularly practical embodiment, the press frame can have an upper and a lower holding plate that are connected by a plurality of vertical spacers. This yields particularly high stability. The drive motors of the upper drive units can furthermore be fastened to the upper holding plate of the press frame, and the drive motors of the lower drive units can be fastened to the lower holding plate of the press frame. The drive motors are therefore arranged on the press frame such that they are not entrained during a vertical movement of the press punch, or respectively the receptacle. This increases the stability and improves the result of pressing. A bearing element can be provided that is arranged on the vertical spacers of the press frame between the upper and lower holding plate of the press frame. The bearing element can, for example, to be designed as a single piece. The receptacle can be arranged on the bearing element. As mentioned, the receptacle can be formed in a die plate. The die plate can be formed separate from the bearing element and, for example, be fastened to the bearing element. The upper and lower punch can then move relative to the bearing elements and hence to the die plate with the receptacle. For particularly high stability, the bearing element can possess a U-shape that lies in a plane oriented perpendicular to the longitudinal axis of the press frame, in particular a horizontal plane.

BRIEF DESCRIPTION OF THE DRAWINGS

Exemplary embodiments of the invention are explained below in greater detail with reference to figures. They show schematically.

DETAILED DESCRIPTION OF THE INVENTION

Figure 1:
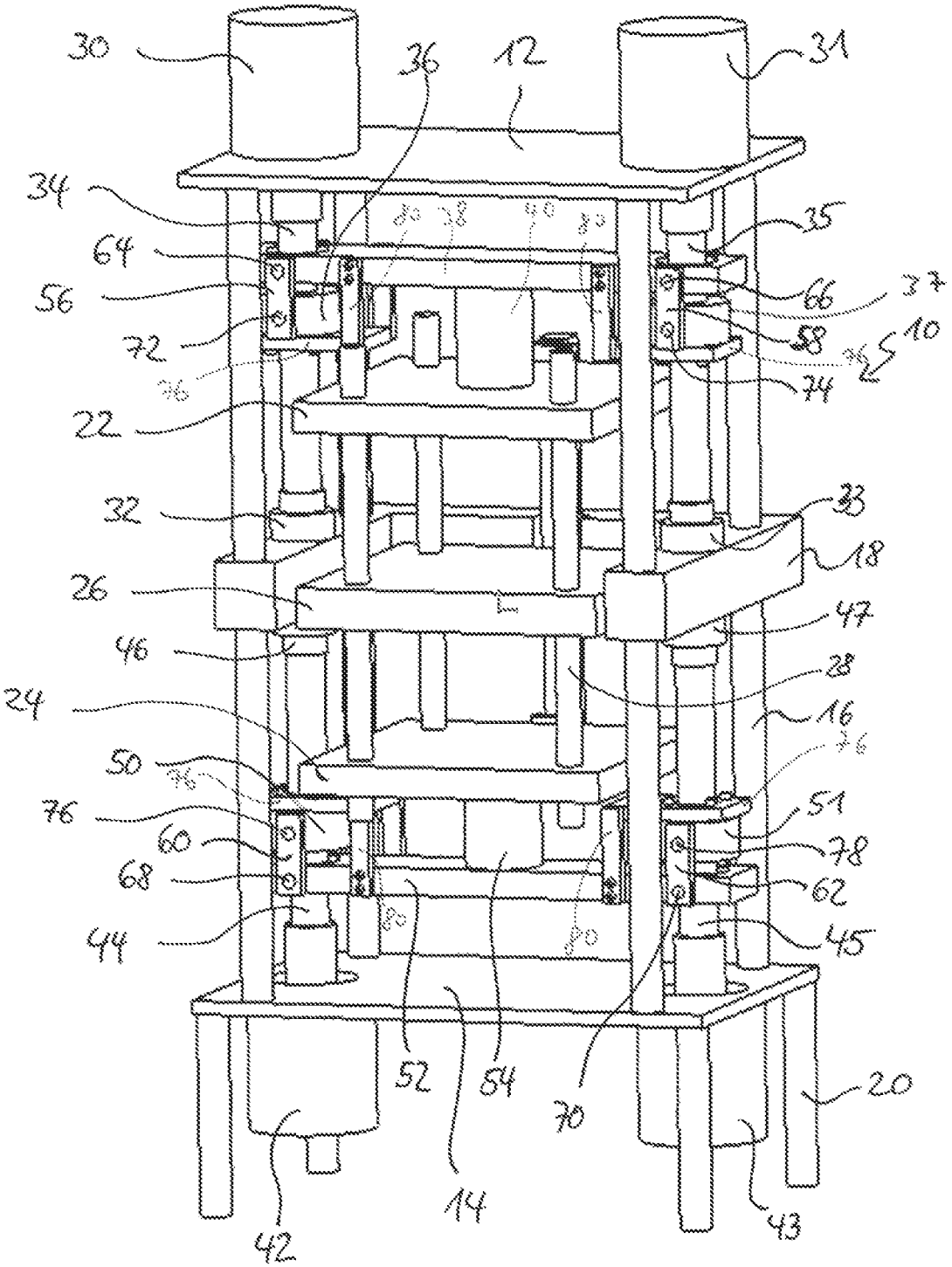
FIG. 1 A perspective view of a press according to the invention.

While this invention may be embodied in many forms, there are described in detail herein specific embodiments of the invention. This description is an exemplification of the principles of the invention and is not intended to limit the invention to the particular embodiments illustrated.

If not otherwise specified, the same reference numbers indicate the same objects in the figures. The press according to the invention possesses a press frame 10 with an upper holding plate 12 and a lower holding plate 14. The upper and lower holding plates 12, 14 are connected to each other by means of four spacers 16 running in a vertical direction in the portrayed example, and to a bearing element 18 arranged approximately in the middle between the upper and lower holding plates 12, 14. In the portrayed example, the bearing element 18 is designed as a single part and possesses a U-profile lying in a horizontal plane, an arrangement and extension plane. The lower holding plate 14 stands on the supporting surface by means of four support legs 20. Furthermore, the press possesses an upper punch plate 22 with an upper punch (not shown) and a lower punch plate 24 with a lower punch (also not shown). In the portrayed example, a die plate 26 is arranged between the upper punch plate 22 and the lower punch plate 24 with a receptacle (not shown) for powder to be pressed between the upper and lower punch, such as metal or ceramic powder. In the portrayed example, the upper punch plate 22, the lower punch plate 24, and the die plate 26 are connected to each other by means of vertical guide columns 28. In the portrayed example, the die plate 26 is directly attached to the bearing element 18.

The press according to the invention furthermore comprises two upper drive units for vertically moving the upper punch plate 22, and two lower drive units for vertically moving the lower punch plate 24. The upper and lower drive units are each arranged on opposite sides of the press frame 10. The upper drive units comprise in each case an upper electric drive motor 30, 31 arranged on the upper holding plate 12 and an upper spindle drive. The upper spindle drives comprise in each case an upper fixed bearing 32, 33 that is fastened in each case directly to the top side of the bearing element 18. The electric upper drive motors 30, 31 each rotatably drive an axially fixed upper spindle 34, 35. An upper axially movable upper spindle nut 36, 37 is arranged on each of the upper spindles 34, 35. When the upper spindles 34, 35 rotate, this therefore generates an axial movement of the respective upper spindle nuts 36, 37. In a manner explained further below, the upper spindle nuts 36, 37 are fastened to opposite ends of an upper, bar-shaped power transmission bridge 38 which is connected in the middle to the upper punch plate 22 by means of another power transmission element 40. The upper drive units with their upper drive motors 30, 31 therefore act laterally offset on the upper punch plate 22 and hence on the upper punch by means of the power transmission bridge 38.

The design of the two bottom drive units is accordingly identical to the design of the two upper drive units. Accordingly, the lower drive units each have a lower electric drive motor 42, 43 that is arranged on the lower holding plate 14 and rotatably drives an axially fixed lower spindle 44, 45. A lower fixed bearing 46, 47 of each of the lower spindles 44, 45 is directly fastened to the bottom side of the bearing element 18. An axially movable lower spindle nut 50, 51 is in turn arranged on the lower spindles 44, 45. The lower spindle nuts 50, 51 are in turn arranged on opposite ends of a lower, bar-shaped power transmission bridge 52 which is connected in the middle to the lower punch plate 24 by means of another power transmission element 54. When the lower electric drive motors 42, 43 rotatably drive the lower spindles 44, 45, an axial movement of the lower spindle nuts 50, 51 arises which, in a manner yet to be explained, is transmitted to the lower punch plate 24 by means of the lower power transmission bridge 52 and the power transmission element 54 such that the punch plate is moved in a vertical direction. In turn, the lower drive units with their lower drive motors 42, 43 therefore act laterally offset on the lower punch plate 24 and hence on the lower punch by means of the lower power transmission bridge 52.

In the depicted example, the upper spindle nuts 36, 37 are connected to the upper power transmission bridge 38 by means of a total of four compensation elements, of which two can be seen in FIG. 1 under reference numbers 56, 58. Corresponding compensation elements with an equivalent function are arranged on the rear of the press, hidden in FIG. 1, opposite the compensation elements 56, 58 in each case. The lower spindle nuts 50, 51 are correspondingly connected by means of a total of four compensation elements to the lower power transmission bridge 52, of which two can be seen in FIG. 1 under reference numbers 60, 62. On the other hand, on the rear of the press which cannot be seen in FIG. 1, there are two additional compensation elements opposite compensation elements 60, 62 which are identical to the compensation elements 60, 62 in terms of design and function.

The elongated compensation elements 56, 58, 60, 62 are each rotatably mounted on the upper power transmission bridge 38, or respectively the lower power transmission bridge 52, by means of first pivot bearings 64, 66, 68, 70 in each case. The compensation elements 56, 58, 60, 62 are each rotatably mounted on the upper, or respectively lower spindle nuts by means of second pivot bearings 72, 74, 76, 78. It can be seen that the pivot bearings of a compensation element in the rest position of the press shown in FIG. 1 are each arranged over each other in a vertical direction. The longitudinal axis of the elongated compensation elements 56, 58, 60, 62 also extends in a vertical direction in this state of rest.

Figure 2:
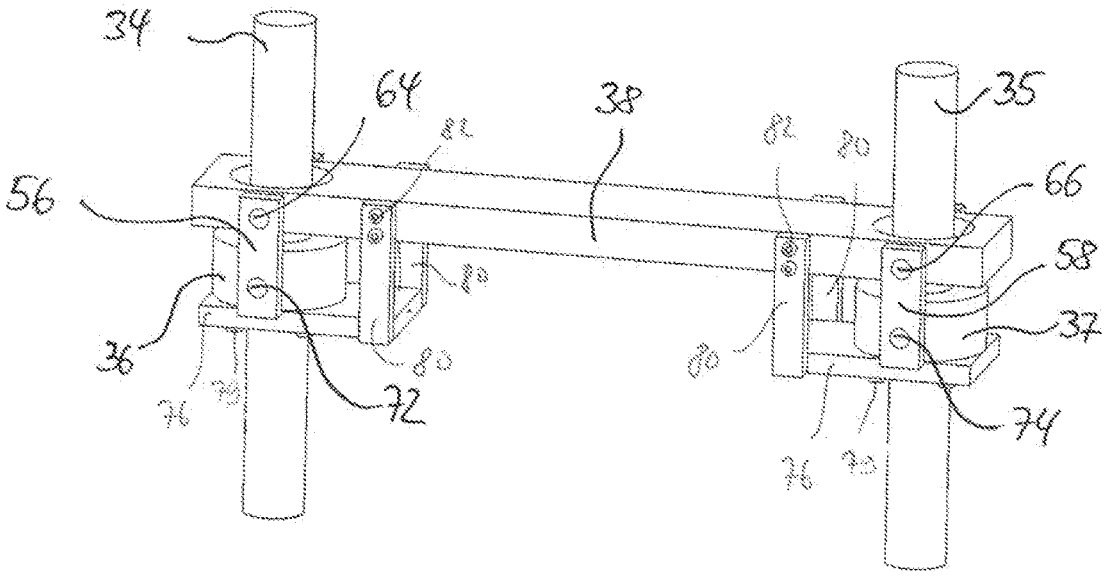
FIG. 2 A detail of the press shown in FIG. 1 in a first operating state, FIG. 3 The detail from FIG. 2 in a second operating state, FIG. 4 A representation of an enlarged section of a part of the representation from FIG. 2.
Figure 3:
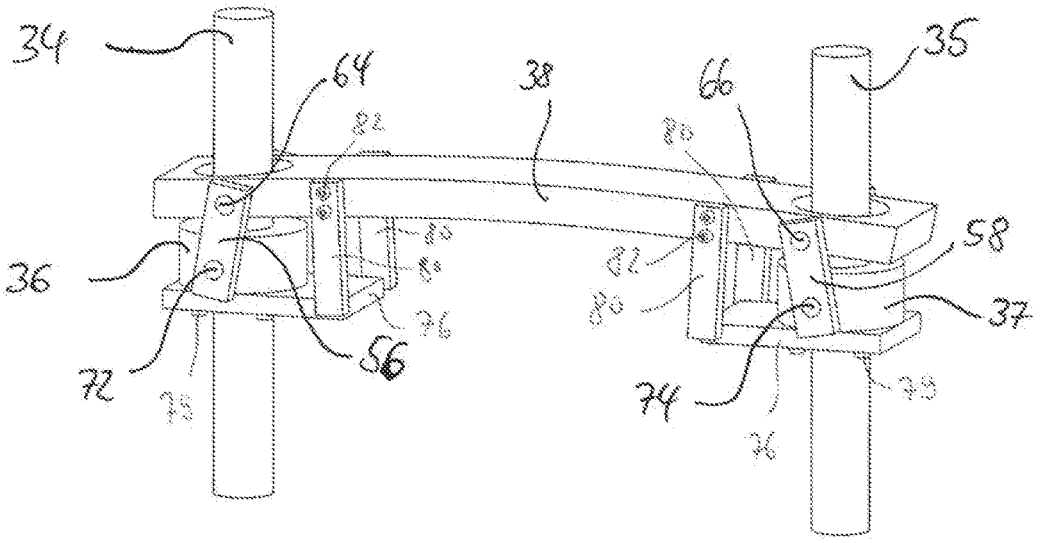

The function of the compensation elements will be explained as an example in relation to the upper power transmission bridge 38 with reference to FIGS. 2 and 3. Of course, the function of the compensation elements in relation to the lower power transmission bridge 52 is accordingly identical. As in FIG. 1, the state of rest of the press in the section from FIG. 1 is shown in FIG. 2. During a pressing operation, enormous forces arise. These can cause the power transmission bridges 38, 52 to bend as exaggeratedly depicted in FIG. 3 for the sake of illustration with reference to power transmission bridge 38. As can be seen in FIG. 3, this bending of the power transmission bridge 38 leads to a tipping of the compensation elements 56, 58 which is enabled by a rotation about the pivot bearings 64, 72, or respectively 66, 74. The distance decreases between the pivot bearings 64, 66 relative to each other that are provided on the power transmission bridge 38, whereas the distance between the pivot bearings 72, 74 remains substantially constant. As can also be seen in FIGS. 2 and 3, a space exists between the top side of the spindle nuts 36, 37 and the assigned bottom side of the upper power transmission bridge 38 which is sufficiently large so that no direct contact arises between the spindle nuts 36, 37 and the power transmission bridge 38 during the bending depicted in FIG. 3. It can also be seen that the spindles 34, 35 are accommodated in through-holes that in turn are formed in bearing sections at opposite ends of the power transmission bridge 38. The outer diameter of the spindles 34, 35 is less by a specific amount than the inner diameter of the through-holes in the power transmission bridge 38. Consequently, there is an annular gap between the outside of the spindles 34, 35 and the inside of the through-holes in the power transmission bridge 38. This annular gap is also sufficiently large so that direct contact of the spindles with the power transmission bridge 38 does not arise in the state shown in FIG. 3. Of course, the embodiment of the lower part of the press shown in FIG. 1, in particular the connection between the spindle drives and the power transmission bridge 52, is accordingly identical. The aforementioned embodiments with the compensation elements 56, 58, 60, 62 ensure that no relevant bending moments act on the spindle drives, in particular the spindle nuts 36, 37, 50, 51.

Figure 4:
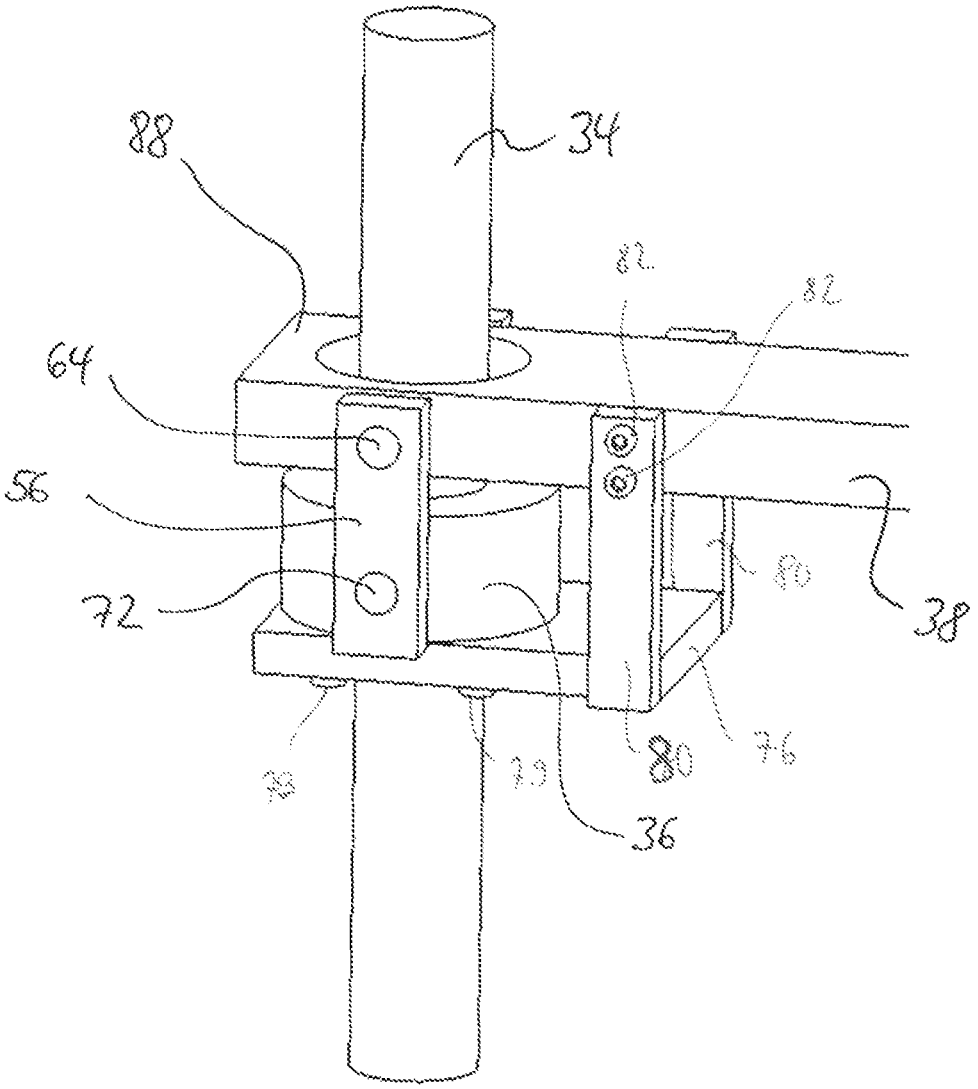

Furthermore, a torque support, or respectively anti-rotation element of the press according to the invention can be seen in the figures, in particular the enlarged representation in FIG. 4. It comprises a reinforcing plate 76 screwed to each of spindle nuts 36, 37, 50, 51 which in the present case is arranged in a horizontal plane. The corresponding screwed connections can be seen under reference sign 79. In the portrayed example, the stiffening plate 76 is screwed to the power transmission bridge 38 by means of two support elements 80. The corresponding screwed connections can be seen under reference sign 82. The torque support secures against undesirable twisting. Of course, corresponding torque supports, or respectively anti-twist elements, are provided on all the spindle nuts 36, 37, 50, 51.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A press for producing a pellet from powdered material, comprising a press frame (10) and a press unit arranged in the press frame (10) with at least one upper press punch and/or at least one lower press punch, as well as at least one receptacle for the powdered material to be pressed by the upper and/or lower press punch, at least two upper drive units, each with one upper electric drive motor (30, 31) for moving the upper press punch in a vertical direction, wherein the upper drive units each comprise one upper spindle drive driven by the respective electric drive motors (30, 31) and having an upper spindle (34, 35) and an upper spindle nut (36, 37), and/or at least two lower drive units, each with a lower electric drive motor (42, 43) for moving the lower press punch and/or the receptacle in a vertical direction, wherein the lower drive units each comprise a lower spindle drive driven by the respective electric drive motor (42, 43) and having a lower spindle (44, 45) and a lower spindle nut (50, 51), wherein the upper drive units act laterally offset on the at least one upper press punch by means of an upper power transmission bridge (38) extending in a horizontal direction, and/or wherein the lower drive units act laterally offset on the at least one lower press punch and/or the receptacle by means of a lower power transmission bridge (52) extending in a horizontal direction, characterized in that the upper spindle nuts (36, 37), or the upper fastening elements each connected to the upper spindle nuts (36, 37), are each connected to the upper power transmission bridge (38) by at least one upper compensation element (56, 58), wherein the compensation elements (56, 58) are each pivotably mounted on the upper spindle nuts (36, 37), or the upper fastening elements on the one hand, and on the upper power transmission bridge (38) on the other hand, and/or that the lower spindle nuts (50, 51), or lower fastening elements connected to the lower spindle nuts (50, 51), are each connected to the lower power transmission bridge (52) by means of at least one lower compensation element (60, 62), wherein the compensation elements (60, 62) are each pivotably mounted on the lower spindle nuts (50, 51), or the lower fastening elements on the one hand and the lower power transmission bridge (52) on the other hand.

2. The press according to claim 1, characterized in that each of the upper spindle nuts (36, 37), or respectively each upper fastening element connected to the upper spindle nuts (36, 37), is connected in each case to the upper power transmission bridge (38) by two upper compensation elements (56, 58), and/or each of the lower spindle nuts (50, 51) or respectively each lower fastening element connected to the lower spindle nuts (50, 51) is connected in each case by two lower compensation elements (60, 62) to the lower power transmission bridge (52).

3. The press according to claim 2, characterized that the compensation elements (56, 58, 60, 62) are each arranged on opposite sides of the power transmission bridge (38, 52).

4. The press according to claim 1, characterized in that the bearing points for pivotably mounting the compensation elements (56, 58, 60, 62) are arranged over each other in a vertical direction when the press is in a state of rest.

5. The press according to claim 1, characterized in that the compensation elements (56, 58, 60, 62) are rotatably mounted by roller bearings or friction bearings.

6. The press according to claim 1, characterized in that the at least two upper drive units act on the opposite ends of the upper power transmission bridge (38), and/or the at least two lower drive units act on the opposite ends of the lower power transmission bridge (52).

7. The press according to claim 1, characterized in that the upper spindles (34, 35), and/or the upper spindle nuts (36, 37), and/or the upper fastening elements do not touch the upper power transmission bridge (38) when the press is in a state of rest and during a pressing operation, and/or the lower spindles (44, 45), and/or the lower spindle nuts (50, 51), and/or the lower fastening elements do not touch the lower power transmission bridge (52) when the press is in a state of rest and during a pressing operation.

8. The press according to claim 1, characterized in that a space is formed between a bottom side or a top side of the upper power transmission bridge (38) and a top side, or respectively a bottom side of the upper spindle nuts (36, 37), or respectively the upper fastening elements, and/or a space can be formed between a bottom side or a top side of the lower power transmission bridge (52) and a top side, or respectively a bottom side of the lower spindle nuts (50, 51), or respectively the lower fastening elements.

9. The press according to claim 1, characterized in that each of the opposite ends of the upper power transmission bridge (38) can possess a cylindrical through-hole, each of which accommodates an upper spindle (34, 45), wherein an annular gap is formed in each case between the insides of the through-holes in the upper power transmission bridge (38) and the outsides of the upper spindles (34, 35), and/or each of the opposite ends of the lower power transmission bridge (52) possesses a cylindrical through-hole, each of which accommodates a lower spindle (44, 45), wherein an annular gap is formed in each case between the insides of the through-holes in the lower power transmission bridge (52) and the outsides of the lower spindles (44, 45).

10. A press according to claim 1, characterized in that a cylindrical upper projection is connected to each of the upper spindle nuts (36, 37), wherein each of the opposite ends of the upper power transmission bridge (38) can possess a cylindrical through-hole, each of which accommodates an upper projection, wherein an annular gap is formed in each case between the insides of the through-holes in the upper power transmission bridge (38) and the outsides of the upper projections, and/or a cylindrical lower projection is connected to each of the lower spindle nuts, wherein each of the opposite ends of the lower power transmission bridge (52) possesses a cylindrical through-hole, each of which accommodates a lower projection, wherein an annular gap is formed in each case between the insides of the through-holes in the lower power transmission bridge (52) and the outsides of the lower projections.

11. The press according to claim 1, characterized in that the press frame (10) can have an upper and a lower holding plate (12, 14) that are connected by a plurality of vertical spacers (16).

12. The press according to claim 11, characterized in that the drive motors (30, 31) of the upper drive units are fastened to the upper holding plate (12) of the press frame (10), and the drive motors (42, 43) of the lower drive units are fastened to the lower holding plate (14) of the press frame (10).

13. The press according to one of claim 11, characterized in that a bearing element (18) is provided that is arranged on the vertical spacers (16) of the press frame (10) between the upper (12) and lower holding plate (14).

14. The press according to claim 13, characterized in that the receptacle is arranged on the bearing element (18).

* * * * *